US005868071A

United States Patent [19]

Niemiro et al.

[11] Patent Number: 5,868,071

[45] Date of Patent: Feb. 9, 1999

[54] VARIABLE CUTOFF PRINTING PRESS

[75] Inventors: Thaddeus A. Niemiro, Lisle; William G. Hannon, Westchester, both of Ill.

[73] Assignee: Goss Graphic Systems, Inc., Westmont, Ill.

[21] Appl. No.: 922,185

[22] Filed: Sep. 2, 1997

[51] Int. Cl.[6] ..... B41F 7/02

[52] U.S. Cl. ..... 101/218; 101/247; 101/226

[58] Field of Search ..... 101/226, 479, 101/218, 182, 184, 185, 139, 247

[56] References Cited

U.S. PATENT DOCUMENTS

| | | | |
|---|---|---|---|
| Re. 35,646 | 11/1997 | Guaraldi et al. | 101/216 |
| 1,590,742 | 7/1926 | Goulding . | |
| 3,150,588 | 9/1964 | Bonsch | 101/218 |
| 3,470,816 | 10/1969 | Piecha et al. | 101/218 |
| 4,141,293 | 2/1979 | Corse | 101/181 |
| 4,365,552 | 12/1982 | Kubert | 101/218 |
| 4,462,311 | 7/1984 | Armelin | 101/218 |
| 5,241,905 | 9/1993 | Guaraldi et al. | 101/216 |
| 5,351,616 | 10/1994 | Gelinas et al. | 101/218 |
| 5,467,712 | 11/1995 | Chou | 101/479 |
| 5,481,972 | 1/1996 | Schmid | 101/479 |
| 5,522,316 | 6/1996 | Singler | 101/479 |
| 5,546,860 | 8/1996 | Riis | 101/218 |
| 5,601,021 | 2/1997 | Katabira et al. | 101/218 |

FOREIGN PATENT DOCUMENTS

| | | | |
|---|---|---|---|
| 2130063 | 8/1994 | Canada . | |
| 0 596 244 A1 | 5/1994 | European Pat. Off. . | |
| 0 639 452 A1 | 2/1995 | European Pat. Off. . | |
| 640605 | 7/1928 | France . | |
| 27 18 299 A1 | 4/1977 | Germany . | |
| 221047 | 9/1924 | United Kingdom | 101/218 |

*Primary Examiner*—Eugene H. Eickholt
*Attorney, Agent, or Firm*—Marshall, O'Toole, Gerstein, Murray & Borun

[57] ABSTRACT

In order to provide a variable cutoff printing press, the press includes a pair of plate cylinders and a pair of blanket cylinders with all of the cylinders having a cylindrical body and a central axis of rotation. The plate cylinders are each mounted perpendicular to at least one side frame in a fixed position such that the axes of the plate cylinders are maintained in spaced parallel relation. The blanket cylinders are also each mounted perpendicular to the side frame by a pair of linear slide assemblies such that the axes of the blanket cylinders are maintained in spaced parallel relation. The linear slide assemblies accommodate linear adjustable positioning of the blanket cylinders along spaced parallel adjustment axes generally in the plane of the side frame. With this arrangement, the blanket cylinders are linearly adjustably positionable along and perpendicular to the adjustment axes to adjust the spacing between the plate and blanket cylinders to accommodate blanket sleeves of different thicknesses.

26 Claims, 4 Drawing Sheets

10
12a
18
20a
28
32
42
74
66
112
106
4
116
70
78
34
30
20b
12b
4
72
26
102
64
110
68
114
76
30
28
80a
74
44
66
112
70
104
116
78
46
80b 10
12a
12b
18
20a
20b
28
30
32
34
40
42
44
46
48
50
54
56a
56b
56c
56d
58a
58b
58c
58d
60a
60b
60c
60d
62a
62b
62c
62d
64
68
70
72
74
76
78
80a
80b
86a
86b
102
104
106
108
110
112
114
116
6
7

VARIABLE CUTOFF PRINTING PRESS

FIELD OF THE INVENTION

The present invention is directed to improvements in printing presses and, more particularly, to a printing press that is capable of providing a variable printed image cutoff.

BACKGROUND OF THE INVENTION

Typically, a printing press will utilize two printing couples and will have an inking mechanism for each of the two printing couples. The printing couples comprise a pair of plate cylinders that are commonly journaled at their opposite ends in spaced parallel side frames as well as a corresponding pair of blanket cylinders that are similarly journaled in the side frames. Further, the printing press will be formed to have a throw-off mechanism usually based on a system of eccentric sleeves and associated linkages.

For a printing press of this type, the press will commonly be designed to utilize a specific diameter of plate and blanket cylinders. It will be understood that the diameter of the cylinders dictates the printed image cutoff which has been difficult to vary since it has involved entirely changing the printing press components by essentially rebuilding the press. Understandably, this is a very costly operation to perform, and it is undesirable from the standpoint of productivity and use of resources.

In other words, there is a great amount of "down time" when it is desired to change the cutoff in a conventional printing press. To achieve this objective, it is also necessary to have multiple different sized components including various diameters of plate and blanket cylinders along with different gears, bearings and the like in order to be able to rebuild the press to achieve a different printed image cutoff. As a result, the cost of changing the cutoff has been a deterrent to achieving the level of flexibility that is desired in a printing press.

In an attempt to overcome these problems, Riggs et al. U.S. Pat. No. 2,447,872 suggested a manner of adapting a press for print and blanket cylinders of different diameters. It taught that substantially the same drive elements could be used throughout in constructing a press having cylinders of any one of a variety of diameters, provided appropriate alterations were made in the size of spur gears connecting the components of the printing couples. While eliminating the need for completely different sets of press drive parts, the Riggs et al. '872 patent failed to overcome all of the problems that had been encountered in the art.

By way of further background, Hannon U.S. Pat. No. 5,337,664 also discloses a printing press of the type that utilizes two printing couples. This patent utilizes a pair of blanket cylinders which are movably mounted by a throw-off apparatus to enable separation of the blanket cylinders from each other and from a corresponding pair of plate cylinders. As described therein, a pair of blanket cylinders are typically mounted for movement by means of a throw-off apparatus for separation to create a throw-off gap.

As will be appreciated by those skilled in the art, the throw-off gaps are needed to install and remove plates and blankets from the plate and blanket cylinders. The apparatus utilized for this purpose has conventionally employed a suitable linkage which is pivotally connected to a peripheral arm of an eccentric member to which a shaft of the blanket cylinders is typically mounted. For mounting or dismounting the plates and blankets, the linkage is moved by a conventional drive to turn the eccentric members from an operative to an inoperative position.

While such throw-off apparatus are well known, the same cannot be said for an apparatus for varying printed image cutoff. It would, thus, be highly desirable to have suitable means for mounting and dismounting plates on plate cylinders and blanket sleeves on blanket cylinders where the blanket sleeves have different thicknesses and, thus, different outer diameters to provide desired printing cutoff points. Moreover, to be advantageous, this should be achieved in a manner that does not require the press to be changed to any significant extent.

The present invention is directed to overcoming one or more of the foregoing problems and achieving one or more of the resulting objects.

SUMMARY OF THE INVENTION

Accordingly, it is a principal object of the present invention to provide a printing press which overcomes the disadvantages of known press configurations. It is also an object of the present invention to provide a variable cutoff printing press which makes it possible to change the printed image cutoff without the need for making any significant structural alteration to the printing press itself. It is a further object of the present invention to provide a printing press in which the image cutoff can be changed by utilizing a different thickness in the blanket sleeves.

In accordance with the foregoing, the present invention is directed to a printing press having a pair of plate cylinders with each having a cylindrical body and a central axis of rotation. The printing press also includes means for mounting the plate cylinders from at least one side frame such that the axes of the plate cylinders are maintained in spaced parallel relation. The present invention is also directed to a printing press having a pair of blanket cylinders with each having a cylindrical body and a central axis of rotation. The printing press includes means for mounting the blanket cylinders to the at least one side frame such that the axes of the blanket cylinders are maintained in spaced parallel relation. With this arrangement, the present invention is such that the mounting means accommodates linear adjustable positioning of the blanket cylinders along spaced parallel adjustment axes.

In the exemplary embodiment, the spaced parallel adjustment axes for the blanket cylinders lie in a plane extending generally transverse to the axes of the blanket cylinders. Advantageously, the spaced parallel adjustment axes for the blanket cylinders comprise linear adjustment axes which lie generally in or parallel to the plane of the at least one side frame. To accommodate blanket sleeves of different diameters, the mounting means preferably has a preselected range for linear adjustable positioning of the blanket cylinders along the adjustment axes.

In the preferred embodiment, the mounting means includes a pair of linear slideways in the at least one side frame and a linear slide assembly in each of the pair of linear slideways. It will be appreciated that the linear slide assembly in each of the pair of linear slideways is advantageously axially movable along the corresponding one of the adjustment axes. With this arrangement, the blanket cylinders each preferably include a shaft journaled in the linear slide assembly which is mounted within the at least one side frame for linear sliding movement.

In a most highly preferred embodiment, the printing press includes means for mounting the plate cylinders and the blanket cylinders to a pair of spaced parallel side frames such that the axes of the plate cylinders and blanket cylinders are all maintained in spaced parallel relation. The mounting means preferably includes a pair of linear slide assemblies in each of the side frames for mounting each of the opposite ends of the blanket cylinders to the side frames. Thus, it will be understood that each of the opposite ends of the each of the blanket cylinders is supported in one of the linear slide assemblies. The linear slide assemblies each advantageously include a blanket cylinder mounting block and a pair of linear arms which extend in opposite directions from the mounting block and are carried in opposed sets of linear bearings in a linear slideway. Further, the linear slide assemblies also each preferably include a crank which is mounted for pivotal movement to one of the side frames in spaced relation to each of the linear arms and also include a connecting rod which serves to join each of the cranks to the corresponding one of the linear arms.

With this arrangement, it will be understood that the linear adjustable positioning of the blanket cylinders is achieved when the cranks are pivoted by reason of the connecting rods that join the cranks to the linear arms. It is advantageous in this respect for the linear arms to be disposed in the linear bearings within the linear slideways for linear sliding movement therewithin. Preferably, the printing press also includes a stop for each of the cranks to define a preselected range of linear sliding movement of the linear arms and, thus, linear adjustable positioning of the blanket cylinders.

By reason of the foregoing, the spacing between the centers or axes of the blanket cylinders can be varied to permit use of blanket sleeves of different thicknesses to thereby provide a blanket sleeve outer diameter creating a desired printing cutoff point without the need to change or rebuild the press with costly components and "down time".

Other objects, advantages and features of the present invention will become apparent from a consideration of the following specification taken in conjunction with the accompanying drawings.

DETAILED DESCRIPTION OF THE PREFERRED EMBODIMENT

Figure 1:
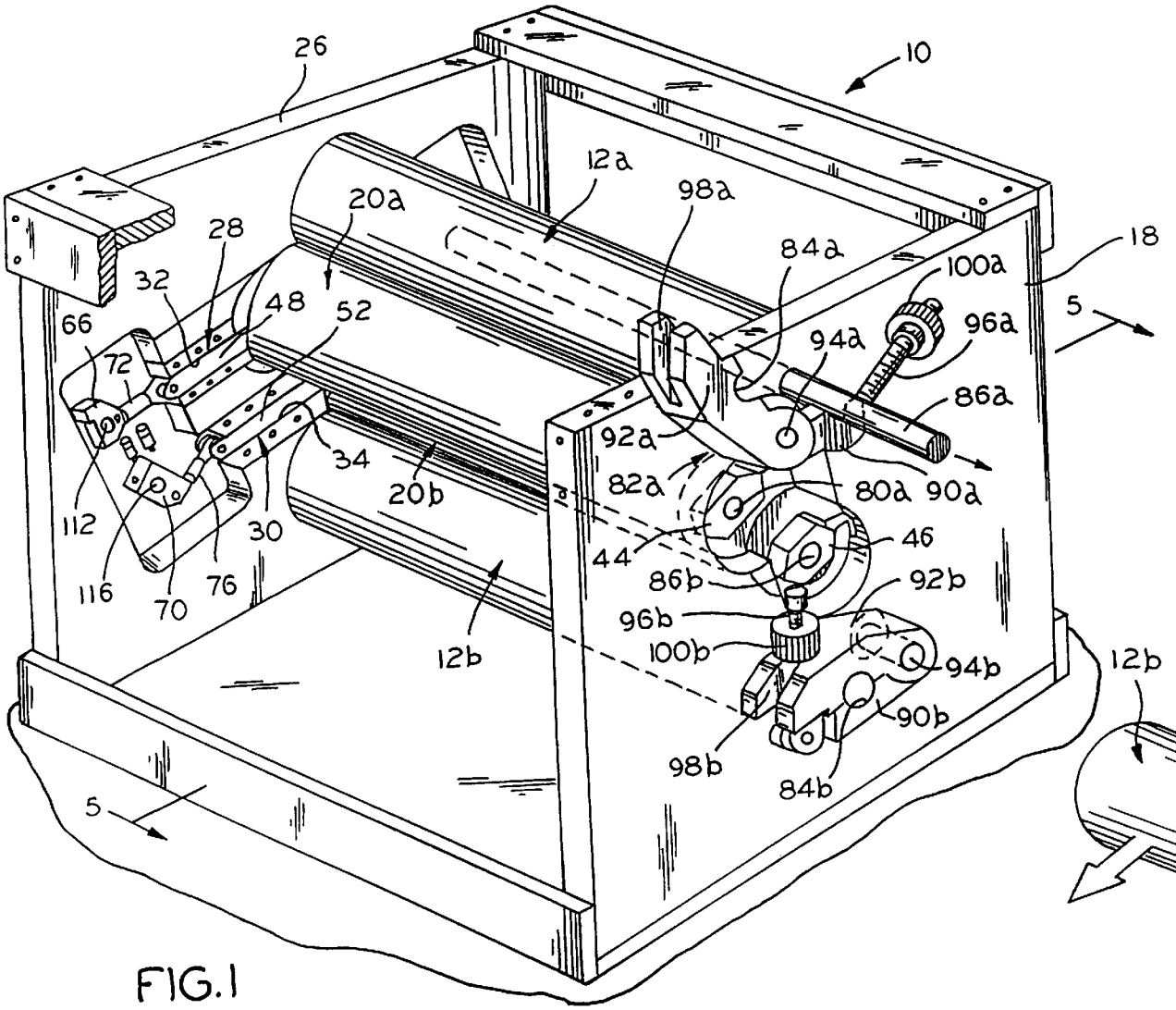
FIG. 1 is a perspective view of a variable cutoff printing press in accordance with the present invention.
Figure 4:
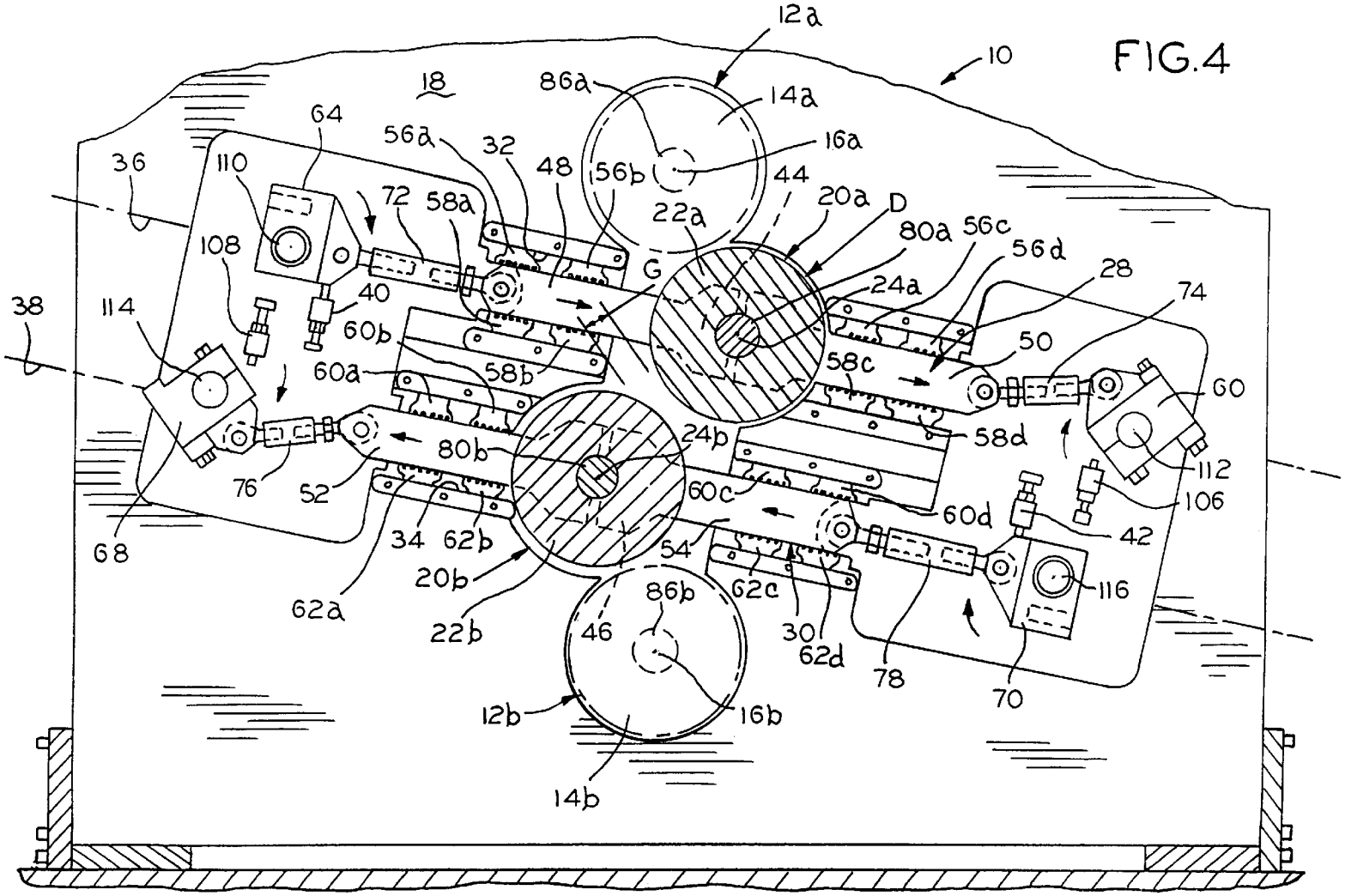
FIG. 4 is a cross-sectional view showing the linear adjustable positioning mechanism taken along the lines 4—4 of FIG. 3.

In the illustrations given, and with reference first to FIGS. 1 and 4, the reference numeral 10 designates generally a printing press having a pair of plate cylinders 12*a* and 12*b* with each having a cylindrical body 14*a* and 14*b* and a central axis of rotation 16*a* and 16*b*, respectively. The printing press 10 includes means for mounting the plate cylinders 12*a* and 12*b* from at least one side frame 18 such that the respective axes 16*a* and 16*b* of the plate cylinders 12*a* and 12*b* are maintained in spaced parallel relation. Additionally, and still with reference to FIGS. 1 and 4, the printing press 10 according to the present invention will be seen to have a pair of blanket cylinders 20*a* and 20*b* with each having a cylindrical body 22*a* and 22*b* and a central axis of rotation 24*a* and 24*b*, respectively.

In the particular embodiment illustrated in FIGS. 1 and 4, the printing press 10 has a pair of spaced parallel side frames 18 and 26 from which the plate cylinders 12*a* and 12*b* are mounted, although it will be appreciated that the plate cylinders 12*a* and 12*b* as well as the blanket cylinders 20*a* and 20*b* could be mounted in cantilevered fashion from one of the side frames such as 18, while still utilizing the advantages that are inherent in the present invention, as will be further described in considerable detail hereinafter.

Figure 3:
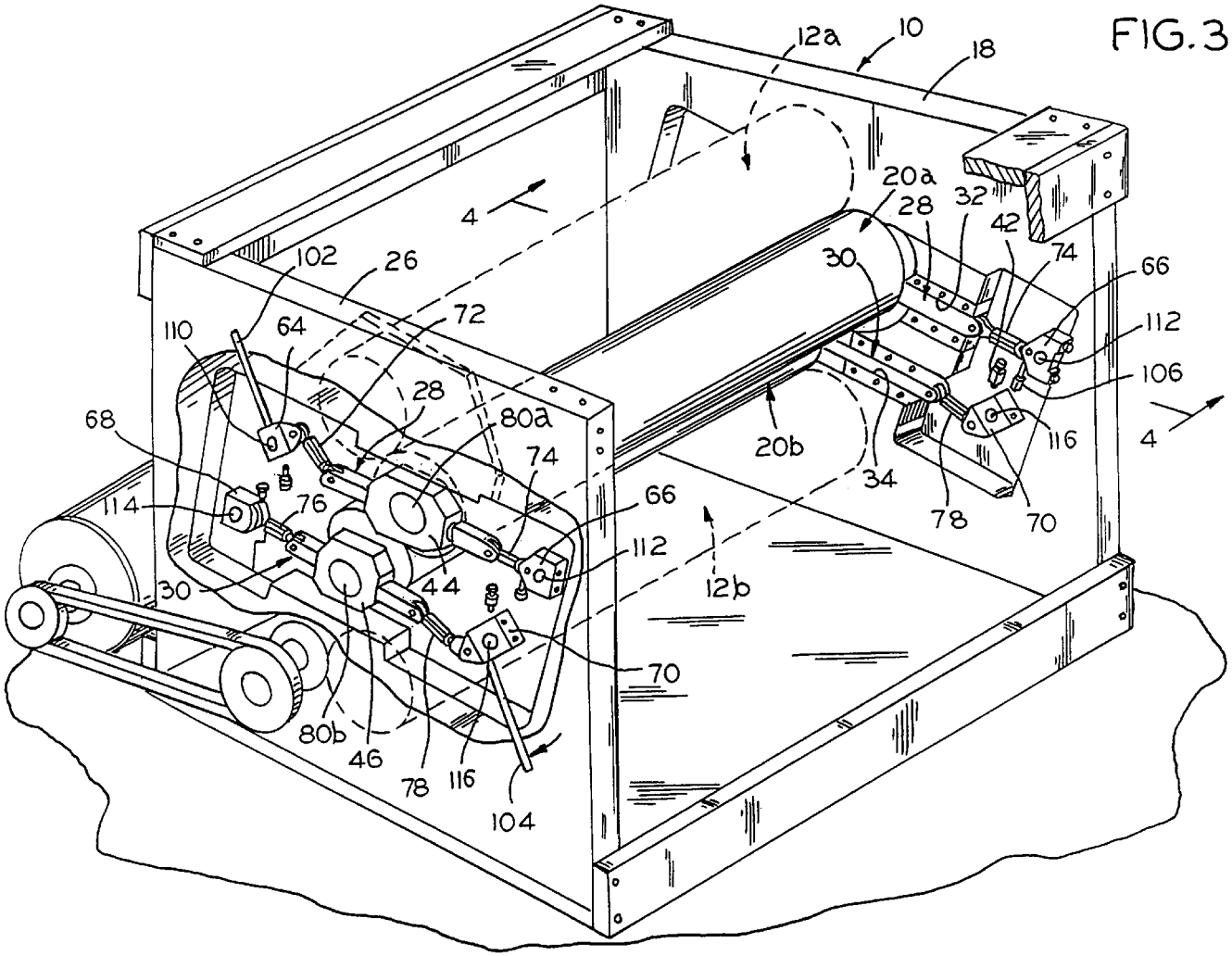
FIG. 3 is a perspective view similar to FIG. 1 showing the mechanism for linear adjustable positioning of the blanket cylinders.

Referring to FIGS. 3 and 4, the printing press 10 includes means for mounting the blanket cylinders 20*a* and 20*b* to the side frames 18 and 26 such that the respective axes 24*a* and 24*b* of the blanket cylinders 20*a* and 20*b* are maintained in spaced parallel relation. The mounting means advantageously comprises a pair of linear slide assemblies generally designated 28 and 30 in each of the side frames 18 and 26. The linear slide assemblies 28 and 30 are each carried in a linear slideway generally designated 32 and 34, respectively, to accommodate linear adjustable positioning of the respective blanket cylinders 20*a* and 20*b* along respective pairs of spaced parallel adjustment axes 36 and 38. As also shown especially in FIG. 4, the printing press 10 includes at least one stop such as 40 and 42 for each of the respective linear slide assemblies 28 and 30 to define a preselected range of linear adjustable positioning of the respective blanket cylinders 20*a* and 20*b*to vary spacing therebetween.

Figures 5, 6, 7:
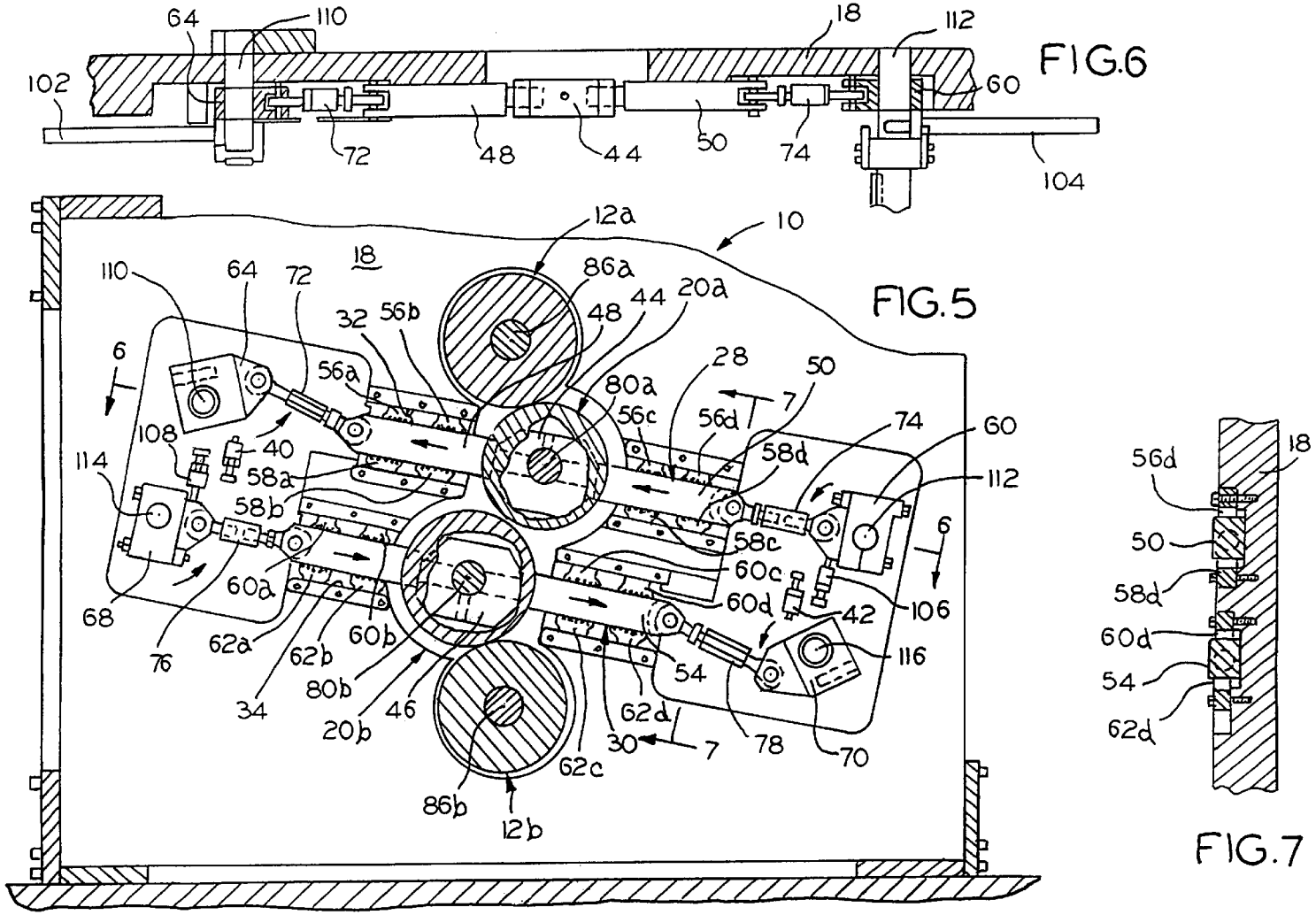
FIG. 5 is a cross-sectional view showing the linear adjustable positioning mechanism taken along the line 5—5 of FIG. 1.
FIG. 6 is a cross-sectional view showing the linear adjustable positioning mechanism taken along the line 6—6 of FIG. 5.
FIG. 7 is a cross-sectional view showing the linear adjustable positioning mechanism taken along the line 7—7 of FIG. 5.

Referring specifically to FIGS. 3–5, the linear slide assemblies 28 and 30 each include a blanket cylinder mounting block such as 44 and 46, respectively, and a pair of linear arms such as 48, 50 and 52, 54, respectively, extending in opposite directions from the mounting blocks 44 and 46. It will be seen that the linear arms such as 48 and 50, which are integral with and extend from the mounting block 44, are carried in opposed sets of linear bearings such as 56*a*–56*d* and 58*a*–58*d* in the linear slideway 32 and, likewise, the linear arms such as 52 and 54, which are integral with and extend from the mounting block 46, are carried in opposed sets of linear bearings such as 60*a*–60*d* and 62*a*–62*d* in the linear slideway 34. The linear slide assemblies 28 and 30 also each include one or more cranks such as 64, 66 and 68, 70, respectively, mounted to the side frames 18 and 26 for pivotal movement in spaced relation to each of the corresponding linear arms such as 48, 50 and 52, 54, respectively. It will further be seen that each of the linear slide assemblies 28 and 30 also each include a connecting rod such as 72, 74 and 76, 78, respectively, joining each of the cranks such as 64, 66 and 68, 70, respectively, to the corresponding one of the linear arms such as 48, 50 and 52, 54, respectively, to accommodate linear adjustable positioning of the blanket cylinders 20*a* and 20*b* along the respective pairs of spaced parallel adjustment axes 36 and 38.

As will be appreciated by referring to FIGS. 4 and 5, the linear arms 48, 50 and 52, 54 extending from the respective mounting blocks 44 and 46 are suitably disposed in the respective linear bearings 56*a*–56*d*, 58*a*–58*d* and 60*a*–60*d*, 62*a*–62*d* within the respective linear slideways 32 and 34 to accommodate linear sliding movement of the respective linear arms 48, 50 and 52, 54 in either direction therewithin. Thus, with the blanket cylinders 20*a* and 20*b* having opposite ends of their shafts 80*a* and 80*b* journaled in the mounting blocks 44 and 46, respectively, in each of the side frames 18 and 26, the spacing between the blanket cylinders 20*a* and 20*b* can be varied to permit use of blankets of different thicknesses to thereby provide a blanket sleeve outer diameter creating a particular desired printing cutoff point.

While not specifically shown, it will be understood by those skilled in the art that a blanket sleeve will be disposed on the cylindrical bodies 22*a* and 22*b* of each of the blanket cylinders 20*a* and 20*b* and a printing plate will be disposed on the cylindrical bodies 14*a* and 14*b* of each of the plate cylinders 12*a* and 12*b*. The cylindrical bodies 14*a*, 14*b* and 22*a*, 22*b* will each have a fixed outer diameter to receive the printing plates and blanket sleeves, respectively, that will each similarly have a fixed inner diameter substantially the same as the corresponding cylindrical body outer diameter for placement thereon. In this manner, and as will readily apparent to those skilled in the art, the printing plates and blanket sleeves can be mounted on and dismounted from the cylindrical bodies 14*a*, 14*b* and 22*a*, 22*b* of the respective plate cylinders 12*a* and 12*b* and blanket cylinders 20*a* and 20*b* in ways that are known and entirely conventional.

Figure 2:
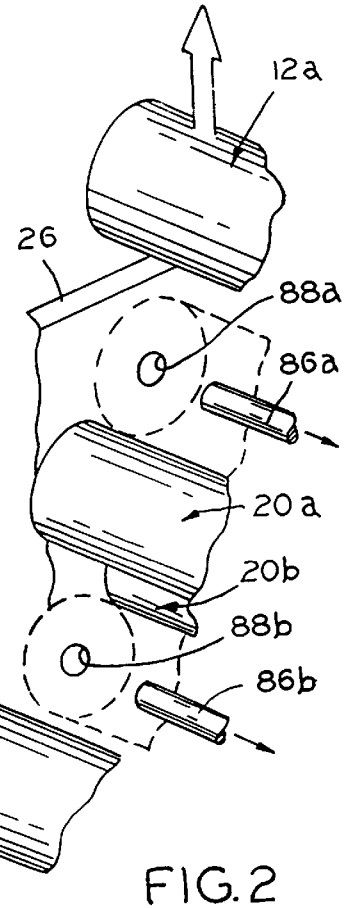
FIG. 2 is a fragmentary perspective view showing removal of plate cylinders from the printing press of FIG. 1.

Referring to FIG. 1, the printing press 10 may advantageously include means associated with the side frames 18 and 26 for each of the plate cylinders 12*a* and 12*b* for quick release of the plate cylinders 12*a* and 12*b*from the side frames 18 and 26 for replacing the printing plates. The quick release means each advantageously comprise a releasable clamp generally designated 82*a* and 82*b* wherein each of the releasable clamps 82*a* and 82*b* has an opening 84*a* and 84*b*, respectively, for receiving an end of a shaft such as 86*a* and 86*b* which is associated with the corresponding one of the respective plate cylinders 12*a* and 12*b*. As will be appreciated by comparing FIGS. 1 and 2, the releasable clamps 82*a* and 82*b* can be mounted on the side frame 18 whereas the side frame 26 can have holes 88*a* and 88*b* to receive the opposite ends of the shafts 86*a* and 86*b* associated with the corresponding one of the plate cylinders 12*a* and 12*b*, respectively.

Still referring to FIG. 1, the releasable clamps 82*a* and 82*b* advantageously each include a shaft-receiving base portion such as 90*a* and 90*b*, respectively, mounted in a fixed position on the frame 18, and they also each include a shaft-clamping portion such as 92*a* and 92*b*, respectively, pivotally mounted to the corresponding one of the base portions 90*a* and 90*b*. This pivotal mounting is suitably accomplished by means of respective pins 94*a* and 94*b*, respectively, which permit the shaft-clamping portions 92*a* and 92*b* to be pivoted about the pins 94*a* and 94*b* to cause the respective shafts 86*a* and 86*b* of the plate cylinders 12*a* and 12*b* so as to be confined within the respective shaft-receiving openings 84*a* and 84*b*. When this has been done, respective pivotable threaded rods 96*a* and 96*b* can be pivoted into the corresponding slots 98*a* and 98*b* following which the respective knurled knobs 100*a* and 100*b* can be threadably tightened into engagement with the corresponding shaft-clamping portions 92*a* and 92*b* to confine the shafts 86*a* and 86*b* within the shaft-receiving openings 84*a* and 84*b*, respectively.

With the shafts 86*a* and 86*b* confined within the respective shaft-receiving openings 84*a* and 84*b*, the plate cylinders 12*a* and 12*b* are in an operative position for utilization of the printing press 10.

Referring to FIG. 3, the linear slide assemblies 28 and 30 have been shown with respective rods 102 and 104 extending from each of the cranks 64 and 70. These rods 102 and 104 are provided to manually impart linear movement to the linear slide assemblies 28 and 30 to accommodate linear adjustable positioning of the blanket cylinders 20*a* and 20*b*. Alternatively, the rods 102 and 104 could be replaced by any suitable form of hydraulic, pneumatic, or other means for pivoting the cranks in relation to the side frames.

As clearly shown in FIG. 4, the linear slide assemblies 28 and 30 may also be provided with second stops 106 and 108 for engagement by the cranks 66 and 68, respectively. It will be appreciated that the cranks 64 and 70 will move until they engage the respective stops 40 and 42 when linear movement is imparted to the blanket cylinders 20*a* and 20*b* in the direction of the arrows in FIG. 4 and the cranks 66 and 68 will move until they engage the respective stops 106 and 108 when linear movement is imparted to the blanket cylinders 20*a* and 20*b* in the opposite direction. As shown in FIG. 4, the stops 40, 42 and 106, 108 can be adjusted by having an internally threaded body fixed to the side frame together with an stop adjustment screw threaded therethrough.

By utilizing hydraulic or pneumatic means, for example, for pivoting the cranks 64 or 66 and 68 or 70 in relation to the side frames 18 and 26, another advantage can be achieved. It will be appreciated in this connection that such a "non-manual" means for pivoting the cranks can be used, not only to separate the blanket cylinders from the plate cylinders and each other in place of the conventional eccentric and linkage throw-off mechanisms, but they can also be used to position the blanket cylinders in desired linear positions of adjustment to control the squeeze of the blankets after blanket sleeves of selected thickness and, thus, outer diameter, have been placed on the blanket cylinders. If manual means are used to pivot the cranks 64 or 66 and 68 or 70, the stops 40, 106 and 42, 108 can be used to maintain the linear slide assemblies 28 and 30 in a desired position.

In addition to the foregoing, the connecting rods 72, 74 and 76, 78 can be made adjustable to fine tune the respective linear slide assemblies 28 and 30. It will be appreciated from FIG. 4 that the connecting rods can comprise internally threaded sleeves having pivotally mounted threaded rods extending from the corresponding cranks and linear arms and threaded into the sleeves. As with the stops 40, 42 and 106, 108, the actual details of the connecting rods will now be apparent to those of ordinary skill in the art.

As for other details of construction, FIG. 5 illustrates the manner in which the shafts 80*a* and 80*b* of the blanket cylinders 20*a* and 20*b*are journaled into the mounting block 44 and 46. It will also be seen from FIGS. 4 and 6 exactly how the linear slide assemblies 28 and 30 are secured in relation to the side frames wherein the cranks 64, 66 and 68, 70 are pivotally secured thereto by means of respective pins 110, 112 and 114, 116. Still additionally, FIG. 7 illustrates the manner in which the linear bearings 56*a*–56*d*, 58*a*–58*d* and 60*a*–60*d* and 62*a*–62*d* are secured within suitable recesses in the side frames.

By comparing FIGS. 4 and 5, it will be seen that the spacing between each of the blanket cylinders 20*a* and 20*b* and their respective plate cylinders 14*a* and 14*b* can be varied by means of the linear slide assemblies 28 and 30. This makes it possible to utilize blanket sleeves of different thicknesses depending upon the requirements for a particular printing operation. In this manner, it will be understood that the blanket sleeve outer diameter can be varied by selecting blanket sleeves of different thicknesses for use on the blanket cylinders in order to create a desired printing cutoff point.

While not essential to a broad understanding of the invention, it will be understood that the shafts 80*a*, 80*b* and/or 86*a*, 86*b* are preferably fixed or non-rotatable shafts. It may then be the case that the plate cylinders 12*a*, 12*b* and/or blanket cylinders 20*a*, 20*b* may be driven by utilizing appropriate gearing (not shown) and/or hollow driven shafts (not shown) surrounding the fixed or non-rotatable shafts. Since these features of construction do not form a part of the present invention, they have not been shown in the drawings or otherwise described in significant detail herein.

From the foregoing, it will also be appreciated that the actual drive or drives for the printing press 10 have not been shown. This is because the press drive or drives and other components such as gears and the like may take any conventional form and are not necessary for understanding the present invention. Thus, the present invention is not dependent on the drive or drives which can readily be selected and implemented by those of ordinary skill in the art.

While in the foregoing there has been set forth a preferred embodiment of the invention, it will be appreciated that the details herein given may be varied by those skilled in the art without departing from the true spirit and scope of the appended claims.

What is claimed is:

1. In a printing press having a pair of plate cylinders with each having a cylindrical body and a central axis of rotation, means for mounting the plate cylinders from at least one side frame such that the axes of the plate cylinders are in spaced parallel relation, the printing press also having a pair of blanket cylinders with each having a cylindrical body and a central axis of rotation, the improvement comprising:

means for mounting the blanket cylinders to the at least one side frame such that the axes of the blanket cylinders are in spaced parallel relation, the mounting means accommodating linear adjustable positioning of the blanket cylinders along spaced parallel adjustment axes, the spaced parallel adjustment axes for the blanket cylinders lying in a plane generally transverse to the axes of the blanket cylinders.

2. The printing press of claim 1 wherein the spaced parallel adjustment axes for the blanket cylinders are linear adjustment axes lying generally in the plane of the at least one side frame.

3. The printing press of claim 1 wherein the mounting means includes a pair of linear slideways in the at least one side frame and a linear slide assembly in each of the pair of linear slideways.

4. The printing press of claim 3 wherein the linear slide assembly in each of the pair of linear slideways is axially movable along the corresponding one of the spaced parallel adjustment axes.

5. The printing press of claim 1 wherein the blanket cylinders each include a shaft journaled in a linear slide assembly mounted within the at least one side frame for linear sliding movement.

6. The printing press of claim 1 including a blanket sleeve disposed on the cylindrical body of each of the blanket cylinders and having a thickness selected to provide a desired printing cutoff point.

7. The printing press of claim 1 wherein the mounting means has a preselected range for linear adjustable positioning of the blanket cylinders to accommodate blanket sleeves of different outer diameters.

8. In a printing press having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:

means for mounting the blanket cylinders to the side frames such that the axes of the blanket cylinders are maintained in spaced parallel relation, the mounting means accommodating linear adjustable positioning of each of the blanket cylinders along respective pairs of spaced parallel adjustment axes in each of the side frames, the spaced parallel adjustment axes for the blanket cylinders being linear adjustment axes lying generally in the planes of the side frames, the mounting means including a respective pair of linear slide assemblies in each of the side frames each of which is carried in a linear slideway so as to be axially movable, the linear slide assemblies being axially movable along the corresponding ones of the linear adjustment axes for the blanket cylinders.

9. The printing press of claim 8 wherein the blanket cylinders each include a non-rotatable shaft having opposite ends each of which is journaled in one of the linear slide assemblies for linear sliding movement within the corresponding one of the linear slideways for linearly adjustably positioning the blanket cylinders.

10. The printing press of claim 8 including a blanket sleeve on the cylindrical body of each of the blanket cylinders and a printing plate on each of the printing cylinders with each of the blanket sleeves having a thickness selected to provide a blanket sleeve outer diameter creating a desired printing cutoff point.

11. The printing press of claim 8 wherein the mounting means includes at least one stop for each of the linear slide assemblies to define a preselected range of linear adjustable positioning of the blanket cylinders along the respective pairs of spaced parallel adjustment axes to vary spacing between the blanket cylinders.

12. The printing press of claim 8 including means associated with the side frames for each of the printing cylinders for quickly releasing the printing cylinders from the side frames for replacing the printing plates while normally securing the printing cylinders in an operative position during a printing operation.

13. The printing press of claim 8 including a crank disposed in spaced relation to one end of each of the linear slide assemblies, the cranks being mounted to the side frames for pivotal movement, and including a connecting rod joining each of the cranks to the end of the corresponding one of the linear slide assemblies.

14. The printing press of claim 8 wherein each of the linear slideways is defined by opposed sets of linear bearings, each of the linear slide assemblies includes an arm carried by the set of linear bearings in the corresponding linear slideway, and each of the linear arms extends along the corresponding one of the adjustment axes.

15. In a printing press having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:

a pair of linear slide assemblies in each of the side frames for mounting the blanket cylinders to the side frames such that the axes of the blanket cylinders are maintained in spaced parallel relation, the linear slide assemblies each being carried in a linear slideway to accommodate linear adjustable positioning of the blanket cylinders along respective pairs of spaced parallel adjustment axes, and at least one stop for each of the linear slide assemblies to define a preselected range of linear adjustable positioning of the blanket cylinders to vary spacing between the blanket cylinders.

16. The printing press of claim 15 wherein the blanket cylinders each include a non-rotatable shaft having opposite ends each of which is journaled in one of the linear slide assemblies for linear sliding movement within the corresponding one of the linear slideways for linearly adjustably positioning the blanket cylinders.

17. The printing press of claim 15 including a blanket sleeve on the cylindrical body of each of the blanket cylinders and a printing plate on the cylindrical body of each of the printing cylinders with each of the blanket sleeves having an outer diameter determined by the thickness to provide a desired printing cutoff point.

18. The printing press of claim 15 including means associated with the side frames for each of the printing cylinders for quickly releasing the printing cylinders from the side frames for replacing the printing plates while normally securing the printing cylinders in an operative position during a printing operation.

19. The printing press of claim 15 including a crank disposed in spaced relation to one end of each of the linear slide assemblies, the cranks being mounted to the side frames for pivotal movement, and including a connecting rod joining each of the cranks to the end of the corresponding one of the linear slide assemblies.

20. The printing press of claim 15 wherein each of the linear slideways is defined by opposed sets of linear bearings, each of the linear slide assemblies includes an arm carried by the set of linear bearings in the corresponding linear slideway, and each of the linear arms extends along the corresponding one of the adjustment axes.

21. In a printing press having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:

a pair of linear slide assemblies in each of the side frames for mounting the blanket cylinders to the side frames such that the axes of the blanket cylinders are maintained in spaced parallel relation, the linear slide assemblies each including a blanket cylinder mounting block and a pair of linear arms extending in opposite directions from the mounting block and carried in opposed sets of linear bearings in a linear slideway, the linear slide assemblies also each including a crank mounted for pivotal movement in spaced relation to each of the linear arms extending from each of the mounting blocks on the corresponding one of the side frames, the linear slide assemblies also each including a connecting rod joining each of the cranks to the corresponding one of the linear arms to accommodate linear adjustable positioning of the blanket cylinders, and a stop for each of the cranks to define a preselected range of linear adjustable positioning of the blanket cylinders along respective pairs of spaced parallel adjustment axes whereby spacing between the blanket cylinders can be varied to permit use of blanket sleeves of different thicknesses to provide a blanket sleeve outer diameter creating a desired printing cutoff point.

22. The printing press of claim 21 wherein the blanket cylinders each include a non-rotatable shaft having opposite ends each of which is journaled in one of the mounting blocks in each of the side frames.

23. The printing press of claim 22 wherein the linear arms extending from the mounting blocks are disposed in the linear bearings in the linear slideways for linear sliding movement therewithin.

24. The printing press of claim 23 including a blanket sleeve disposed on the cylindrical body of each of the blanket cylinders and a printing plate disposed on the cylindrical body of each of the plate cylinders.

25. The printing press of claim 21 including means associated with the side frames for each of the printing cylinders for quick release of the printing cylinders from the side frames for replacing the printing plates.

26. The printing press of claim 25 wherein the quick release means each comprise a releasable clamp having an opening for receiving an end of a shaft associated with the corresponding one of the printing cylinders to accommodate rotational movement.

* * * * *

US005868071C1

(12) EX PARTE REEXAMINATION CERTIFICATE (5096th)

United States Patent
Niemiro et al.

(10) Number: US 5,868,071 C1
(45) Certificate Issued: Apr. 12, 2005

(54) VARIABLE CUTOFF PRINTING PRESS

(75) Inventors: Thaddeus A. Niemiro, Lisle, IL (US); William G. Hannon, Westchester, IL (US)

(73) Assignee: Goss Graphic Systems, Inc., Westmont, IL (US)

Reexamination Request:
No. 90/006,137, Oct. 31, 2001

Reexamination Certificate for:

| | |
|---|---|
| Patent No.: | **5,868,071** |
| Issued: | **Feb. 9, 1999** |
| Appl. No.: | **08/922,185** |
| Filed: | **Sep. 2, 1997** |

(51) Int. Cl.[7] ..... B41F 7/02
(52) U.S. Cl. ..... 101/218; 101/247; 101/226
(58) Field of Search ..... 101/178, 179, 101/182, 184, 185, 218, 219, 220, 226, 247, 479, 139

(56) References Cited

U.S. PATENT DOCUMENTS

| | | | | |
|---|---|---|---|---|
| 3,616,751 A | | 11/1971 | Mowry | |
| 3,889,596 A | | 6/1975 | Thomas et al. | |
| 5,370,047 A | * | 12/1994 | Compton | 101/216 |
| 5,520,109 A | | 5/1996 | Meschi | |
| 5,570,633 A | | 11/1996 | Schultz et al. | |
| 5,784,961 A | * | 7/1998 | Lorig et al. | 101/375 |
| 5,813,336 A | * | 9/1998 | Guaraldi et al. | 101/218 |

FOREIGN PATENT DOCUMENTS

| | | |
|---|---|---|
| EP | 0 420 299 A1 | 4/1991 |

* cited by examiner

*Primary Examiner*—Leslie Evanisko

(57) ABSTRACT

In order to provide a variable cutoff printing press, the press includes a pair of plate cylinders and a pair of blanket cylinders with all of the cylinders having a cylindrical body and a central axis of rotation. The plate cylinders are each mounted perpendicular to at least one frame in a fixed position such that the axes of the plate cylinders are maintained in spaced parallel relation. The blanket cylinders are also each mounted perpendicular to the side frame by a pair of linear slide assemblies such that the axes of the blanket cylinders are maintained in spaced parallel relation. The linear slide assemblies accommodate linear adjustable positioning of the blanket cylinders along spaced parallel adjustment axes generally in the plane of the side frame. With this arrangement, the blanket cylinders are linearly adjustably positionable along and perpendicular to the adjustment axes to adjust the spacing between the plate and blanket cylinders to accommodate blanket sleeves of different thicknesses.

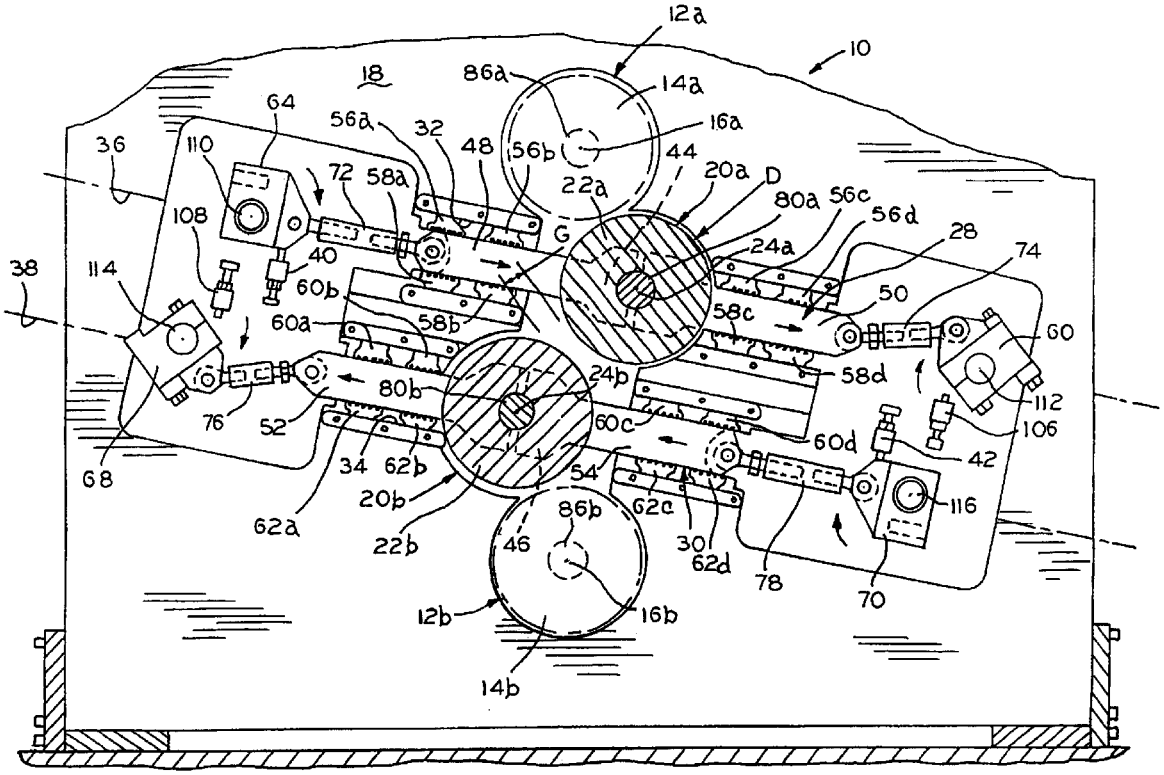

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 21–26 is confirmed.

Claims 1, 8 and 15 are determined to be patentable as amended.

Claims 2–7, 9–14 and 16–20, dependent on an amended claim, are determined to be patentable.

New claims 27–32 are added and determined to be patentable.

1. In a printing press having a pair of plate cylinders with each having a cylindrical body and a central axis of rotation, means for mounting the plate cylinders from at least one side frame such that the axes of the plate cylinders are in spaced parallel relation, the printing press also having a pair of blanket cylinders with each having a cylindrical body and a central axis of rotation, the improvement comprising:

means for mounting the blanket cylinders to the at least one side frame such that the axes of the blanket cylinders are in spaced parallel relation, the mounting means accommodating linear *and non-manual* adjustable positioning of the blanket cylinders along spaced parallel adjustment axes, the spaced parallel adjustment axes for the blanket cylinders lying in a plane generally transverse to the axes of the blanket cylinders.

8. In a printing press having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:

means for mounting the blanket cylinders to the side frames such that the axes of the blanket cylinders are maintained in spaced parallel relation, the mounting means accommodating linear *and non-manual* adjustable positioning of each of the blanket cylinders along respective pairs of spaced parallel adjustment axes in each of the side frames, the spaced parallel adjustment axes for the blanket cylinders being linear adjustment axes lying generally in the planes of the side frames, the mounting means including a respective pair of linear slide assemblies in each of the side frames each of which is carried in a linear slideway so as to be axially movable, the linear slide assemblies being axially movable along the corresponding ones of the linear adjustment axes for the blanket cylinders.

15. In a printing press having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:

a pair of linear slide assemblies in each of the side frames for mounting the blanket cylinders to the side frames such that the axes of the blanket cylinders are maintained in spaced parallel relation, the linear slide assemblies each being carried in a linear slideway *and arranged* to accommodate *non-manual and* linear adjustable positioning of the blanket cylinders along respective pairs of spaced parallel adjustment axes, and at least one stop for each of the linear slide assemblies to define a preselected range of linear adjustable positioning of the blanket cylinders to vary *the* spacing between the blanket cylinders.

*27. The printing press of claim 21, wherein each of the cranks are mounted to the frame in relation to the blanket cylinders such that the blanket cylinders are non-manually shiftable in opposite directions.*

*28. A printing press having a web path comprising:*

*a pair of spaced apart side frames;*

*a pair of spaced apart plate cylinders, each of the plate cylinders having an axis;*

*means for mounting the plate cylinders from the side frames such that the axes of the plate cylinders are in spaced parallel relation;*

*a pair of blanket cylinders, each of the blanket cylinders having a cylindrical body rotatable about a fixed shaft and defining an axis of rotation;*

*mounting means for mounting the blanket cylinders to the side frames such that the axes of the blanket cylinders are in spaced parallel relation, the mounting means including at least one linear slideway corresponding to each one of the blanket cylinders, each linear slideway defining an exclusively linear adjustment path disposed transverse relative to the axis of rotation of the corresponding blanket cylinder, the adjustment path of a first one of the linear slideways parallel to the adjustment path of a second one of the linear slideways; and*

*non-manual adjustment means arranged to accommodate linear adjustable positioning of the blanket cylinders along spaced parallel adjustment axes and permitting the blanket cylinders to be moved toward and away from each other from opposite sides of the web path.*

*29. A printing press comprising:*

*a pair of plate cylinders, each of the plate cylinders having a cylindrical body and a central axis of rotation;*

*means for mounting the plate cylinders to a supporting frame such that the axes of the plate cylinders are in spaced parallel relation;*

*a pair of blanket cylinders, each of the blanket cylinders defining a rotation axis and mounted for rotation to a non-rotatable support shaft, the support shaft including a pair of ends;*

*mounting means for mounting the support shaft of each of the blanket cylinders to the supporting frame, the mounting means securing the ends of each support shaft such that the axes of rotation of the blanket cylinders are in spaced parallel relation, the mounting*

*means arranged to permit non-manual linear adjustment of the blanket cylinders exclusively along spaced parallel and linear adjustment axes, the spaced parallel adjustment axes disposed generally transverse to the rotation axes of the blanket cylinders.*

*30. The printing press of claim 29, wherein the mounting means of at least one of the support shafts is arranged to permit cantilever attachment to a side frame.*

*31. The printing press of claim 29, wherein the support shaft of each of the blanket cylinders is rotationally fixed.*

*32. The printing press of claim 29, wherein the mounting means for each of the blanket cylinders is operably connected to a non-manual adjustment mechanism.*

* * * * *

US005868071C2

(12) EX PARTE REEXAMINATION CERTIFICATE (6304th)

United States Patent
Niemero et al.

(10) Number: US 5,868,071 C2
(45) Certificate Issued: Jul. 15, 2008

(54) VARIABLE CUTOFF PRINTING PRESS

(75) Inventors: Thaddeus A. Niemero, Lisle, IL (US); William G. Hannon, Westchester, IL (US)

(73) Assignee: U.S. Bank, N.A., St. Paul, MN (US)

Reexamination Request:
No. 90/007,676, Aug. 18, 2005

Reexamination Certificate for:

| | |
|---|---|
| Patent No.: | **5,868,071** |
| Issued: | **Feb. 9, 1999** |
| Appl. No.: | **08/922,185** |
| Filed: | **Sep. 2, 1997** |

Reexamination Certificate C1 5,868,071 issued Apr. 12, 2005

(51) Int. Cl.
*B41F 7/02* (2006.01)

(52) U.S. Cl. ..... 101/218; 101/226; 101/247
(58) Field of Classification Search ..... 101/218
See application file for complete search history.

(56) References Cited

U.S. PATENT DOCUMENTS

| | | | | |
|---|---|---|---|---|
| 3,616,751 A | | 11/1971 | Mowry | |
| 3,889,596 A | | 6/1975 | Thomas et al. | |
| 4,598,640 A | | 7/1986 | Nawrath | |
| 5,005,475 A | * | 4/1991 | Knauer | 101/218 |
| 5,520,109 A | | 5/1996 | Meschi | |
| 5,570,633 A | | 11/1996 | Schultz et al. | |
| 5,601,021 A | | 2/1997 | Katabira et al. | |

FOREIGN PATENT DOCUMENTS

| | | |
|---|---|---|
| EP | 0 420 299 A1 | 4/1991 |
| EP | 0 764 523 A1 | 9/1996 |

* cited by examiner

*Primary Examiner*—Jimmy G. Foster

(57) ABSTRACT

In order to provide a variable cutoff printing press, the press includes a pair of plate cylinders and a pair of blanket cylinders with all of the cylinders having a cylindrical body and a central axis of rotation. The plate cylinders are each mounted perpendicular to at least one frame in a fixed position such that the axes of the plate cylinders are maintained in spaced parallel relation. The blanket cylinders are also each mounted perpendicular to the side frame by a pair of linear slide assemblies such that the axes of the blanket cylinders are maintained in spaced parallel relation. The linear slide assemblies accommodate linear adjustable positioning of the blanket cylinders along spaced parallel adjustment axes generally in the plane of the side frame. With this arrangement, the blanket cylinders are linearly adjustably positionable along and perpendicular to the adjustment axes to adjust the spacing between the plate and blanket cylinders to accommodate blanket sleeves of different thicknesses.

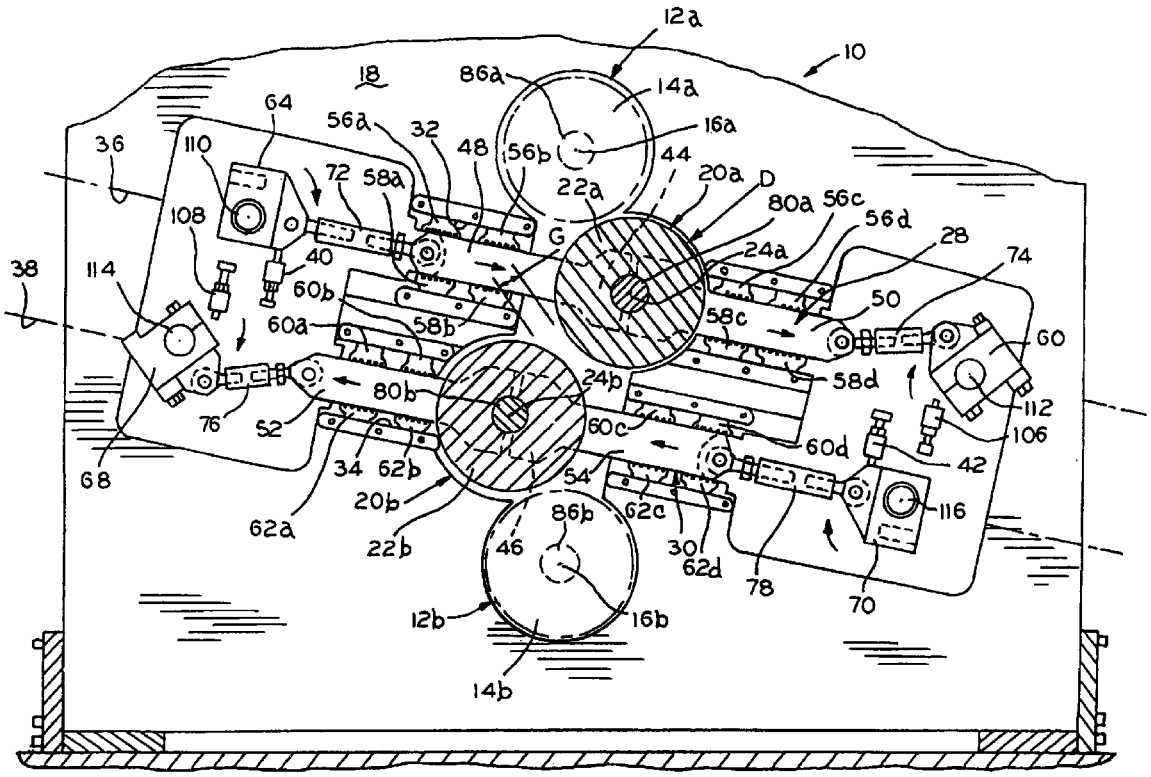

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 21–27 is confirmed.

Claims 1–8, 15 and 28–32 are cancelled.

Claims 9–14 and 16–20 are determined to be patentable as amended.

9. [The] *In a* printing press [of claim 8] *having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:*

*means for mounting the blanket cylinders to the side frames such that the axes of the blanket cylinders are maintained in spaced parallel relation, the mounting means accommodating linear and non-manual adjustable positioning of each of the blanket cylinders along respective pairs of spaced parallel adjustment axes in each of the side frames, the spaced parallel adjustment axes for the blanket cylinders being linear adjustment axes lying generally in the planes of the side frames, the mounting means including a respective pair of linear slide assemblies in each of the side frames each of which is carried in a linear slideway so as to be axially movable, the linear slide assemblies being axially movable along the corresponding ones of the linear adjustment axes for the blanket cylinders; and* wherein the blanket cylinders each include a non-rotatable shaft having opposite ends each of which is journaled in one of the linear slide assemblies for linear sliding movement within the corresponding one of the linear slideways for linearly adjustably positioning the blanket cylinders.

10. The printing press of claim [8] *9* including a blanket sleeve on the cylindrical body of each of the blanket cylinders and a printing plate on each of the printing cylinders with each of the blanket sleeves having a thickness selected to provide a blanket sleeve outer diameter creating a desired printing cutoff point.

11. The printing press of claim [8] *9* wherein the mounting means includes at least one stop for each of the linear slide assemblies to define a preselected range of linear adjustable positioning of the blanket cylinders along the respective pairs of spaced parallel adjustment axes to vary spacing between the blanket cylinders.

12. The printing press of claim [8] *9* including means associated with the side frames for each of the printing cylinders for quickly releasing the printing cylinders from the side frames for replacing the printing plates while normally securing the printing cylinders in an operative position during a printing operation.

13. [The] *In a* printing press [of claim 8 including] *having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:*

*means for mounting the blanket cylinders to the side frames such that the axes of the blanket cylinders are maintained in spaced parallel relation, the mounting means accommodating linear and non-manual adjustable positioning of each of the blanket cylinders along respective pairs of spaced parallel adjustment axes in each of the side frames, the spaced parallel adjustment axes for the blanket cylinders being linear adjustment axes lying generally in the planes of the side frames, the mounting means including a respective pair of linear slide assemblies in each of the side frames each of which is carried in a linear slideway so as to be axially movable, the linear slide assemblies being axially movable along the corresponding ones of the linear adjustment axes for the blanket cylinders; and* a crank disposed in spaced relation to one end of each of the linear slide assemblies, the cranks being mounted to the side frames for pivotal movement, and including a connecting rod joining each of the cranks to the end of the corresponding one of the linear slide assemblies.

14. The printing press of claim [8] *13* wherein each of the linear slideways is defined by opposed sets of linear bearings, each of the linear slide assemblies includes an arm carried by the set of linear bearings in the corresponding linear slideway, and each of the linear arms extends along the corresponding one of the adjustment axes.

16. [The] *In a* printing press [of claim 15] *having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:*

*a pair of linear slide assemblies in each of the side frames for mounting the blanket cylinders to the side frames such that the axes of the blanket cylinders are maintained in spaced parallel relation, the linear slide assemblies each being carried in a linear slideway and arranged to accommodate non-manual and linear adjustable positioning of the blanket cylinders along respective pairs of spaced parallel adjustment axes, and at least one stop for each of the linear slide assemblies to define a preselected range of linear adjustable positioning of the blanket cylinders to vary the spacing between the blanket cylinders; and* wherein the blanket cylinders each include a non-rotatable shaft having opposite ends each of which is journaled in one of the linear slide assemblies for linear sliding movement within the corresponding one of the linear slideways for linearly adjustably positioning the blanket cylinders.

17. The printing press of claim [15] *16* including a blanket sleeve on the cylindrical body of each of the blanket cylinders and a printing plate on the cylindrical body of each of the printing cylinders with each of the blanket sleeves having an outer diameter determined by the thickness to provide a desired printing cutoff point.

18. The printing press of claim [15] *16* including means associated with the side frames for each of the printing cylinders for quickly releasing the printing cylinders from the side frames for replacing the printing plates while normally securing the printing cylinders in an operative position during a printing operation.

19. [The] *In a* printing press [of claim 15 including] *having a pair of plate cylinders with each having a cylindrical body and a central axis of rotation, means for mounting the plate cylinders from a pair of spaced parallel side frame such that the axes of the plate cylinders are in spaced parallel relation, the printing press also having a pair of blanket cylinders with each having a cylindrical body and a central axis of rotation, the improvement comprising:*

*a pair of linear slide assemblies in each of the side frames for mounting the blanket cylinders to the side frames such that the axes of the blanket cylinders are maintained in spaced parallel relation, the linear slide assemblies each being carried in a linear slideway and arranged to accommodate non-manual and linear adjustable positioning of the blanket cylinders along respective pairs of spaced parallel adjustment axes, and at least one stop for each of the linear slide assemblies to define a preselected range of linear adjustable positioning of the blanket cylinders to vary the spacing between the blanket cylinders; and* a crank disposed in spaced relation to one end of each of the linear slide assemblies, the cranks being mounted to the side frames for pivotal movement, and including a connecting rod joining each of the cranks to the end of the corresponding one of the linear slide assemblies.

20. The printing press of claim [15] *19* wherein each of the linear slideways is defined by opposed sets of linear bearings, each of the linear slide assemblies includes an arm carried by the set of linear bearings in the corresponding linear slideway, and each of the linear arms extends along the corresponding one of the adjustment axes.

* * * * *